US006085673A

United States Patent [19]

Bakker et al.

[11] Patent Number: 6,085,673

[45] Date of Patent: Jul. 11, 2000

[54] METHOD FOR REDUCING WATERWALL CORROSION IN LOW $NO_X$ BOILERS

[75] Inventors: Wate T. Bakker, Saratoga; Anthony Facchiano, San Carlos, both of Calif.

[73] Assignee: Electric Power Research Institute, Inc., Palo Alto, Calif.

[21] Appl. No.: 09/100,188

[22] Filed: Jun. 18, 1998

[51] Int. Cl.[7] ..... F23B 7/00; F23N 1/02

[52] U.S. Cl. ..... 110/343; 110/348; 110/347; 110/119; 431/2; 431/10

[58] Field of Search ..... 110/191, 185, 110/186, 187, 188, 297, 314, 343, 344, 345, 347, 348, 147, 296; 122/392; 431/2, 8, 10

[56] References Cited

U.S. PATENT DOCUMENTS

| | | | |
|---|---|---|---|
| 3,257,993 | 6/1966 | Kochey, Jr. | 122/392 |
| 3,274,979 | 9/1966 | Petit | 122/392 |
| 3,276,437 | 10/1966 | Jonakin et al. | 122/392 |
| 3,877,440 | 4/1975 | Winkin | 110/343 X |
| 4,438,709 | 3/1984 | Borio et al. | 110/263 X |
| 4,528,918 | 7/1985 | Sato et al. | 431/10 X |
| 4,915,073 | 4/1990 | Harth et al. | 165/11.2 X |
| 5,020,454 | 6/1991 | Hellewell et al. | 110/297 X |
| 5,740,745 | 4/1998 | Smyrniotis et al. | 110/343 |
| 5,746,143 | 5/1998 | Vatsky | 110/297 |
| 5,809,913 | 9/1998 | Kramer et al. | 110/343 X |

*Primary Examiner*—Ira S. Lazarus
*Assistant Examiner*—Ljiljana V. Ciric
*Attorney, Agent, or Firm*—William S. Galliani; Pennie & Edmonds LLP

[57] ABSTRACT

A method to reduce waterwall corrosion in a low $NO_x$ boiler includes the steps of locating a waterwall area of a low $NO_x$ boiler where oxidizing conditions exist and deposition of FeS is likely. The combustion air input at the waterwall area is biased to reduce FeS deposition on the waterwall. The biased combustion air input increases the oxidation rate of $FeS_2$ so as to reduce FeS deposition on the waterwall. The biased combustion air input may be achieved by increasing the air-to-fuel ratio of one burner while reducing the air-to-fuel ratio of another burner, such that the overall air-to-fuel ratio in the low $NO_x$ boiler is substantially constant.

7 Claims, 3 Drawing Sheets

METHOD FOR REDUCING WATERWALL CORROSION IN LOW $NO_X$ BOILERS

BACKGROUND OF THE INVENTION

1. Field of the Invention

This invention relates generally to reducing corrosion of waterwall tubes in a coal-fired boiler that has a low $NO_x$ system (a low $NO_x$ boiler). More particularly, this invention relates to a method for reducing corrosion of waterwall tubes caused by the presence of FeS deposits.

2. Description of the Related Art

Clean air regulations require a reduction in the flue gas emissions of $NO_x$ compounds from coal-fired boilers. One method for achieving such a reduction is by the use of a low $NO_x$ burner system that employs deep staging. Through the use of deep staging, $NO_x$ production can be reduced by initially burning the coal with insufficient quantities of air in the lower furnace or primary combustion zone. This results in an insufficient concentration of oxygen in the flue gas to combine with nitrogen to form $NO_x$ compounds. As the flue gas passes from the primary combustion zone into the upper furnace area, additional air, known as overfire air, can be added to complete the combustion process.

In boilers operating without low $NO_x$ burner systems, and therefore in the presence of excess oxygen, low alloy or carbon steel waterwalls are protected from corrosion by the formation of an iron oxide scale, typically $Fe_3O_4$, on the surface of the waterwall tubes. This scale is dense and essentially impermeable to gas and adheres strongly to the surface, thereby making fireside corrosion of the waterwall negligible. However, with boilers equipped with low $NO_x$ systems, the lower furnace maintains a reducing environment due to the lack of oxygen, and protective iron oxide scale does not form readily. Instead, the waterwall tubes exhibit increased corrosion caused by FeS deposits. This results in low $NO_x$ boilers experiencing additional downtime and costs.

In view of the foregoing, there exists a need for a method to reduce corrosion of waterwall tubes in boilers that employ low $NO_x$ systems. In particular, there exists a need to reduce the very rapid corrosion caused by FeS deposits.

SUMMARY OF THE INVENTION

A method to reduce waterwall corrosion in a low $NO_x$ boiler includes the steps of locating a waterwall area of a low $NO_x$ boiler where oxidizing conditions exist and deposition of FeS is likely. The combustion air input at the waterwall area is biased to reduce FeS deposition on the waterwall. The biased combustion air input increases the oxidation rate of $FeS_2$ so as to reduce FeS deposition on the waterwall. The biased combustion air input may be achieved by increasing the air-to-fuel ratio of one burner while reducing the air-to-fuel ratio of another burner, such that the overall air-to-fuel ratio in the low $NO_x$ boiler is substantially constant.

The invention reduces waterwall corrosion in a low $NO_x$ boiler, while allowing the boiler to operate with the same low $NO_x$ emissions. The reduced waterwall corrosion mitigates operational downtime and other costs associated with corrosion of the waterwall.

BRIEF DESCRIPTION OF THE DRAWINGS

For a better understanding of the invention, reference should be made to the following detailed description taken in conjunction with the accompanying drawings, in which.

Like reference numerals refer to corresponding parts throughout the drawings.

DESCRIPTION OF THE PREFERRED EMBODIMENTS

Figure 1:
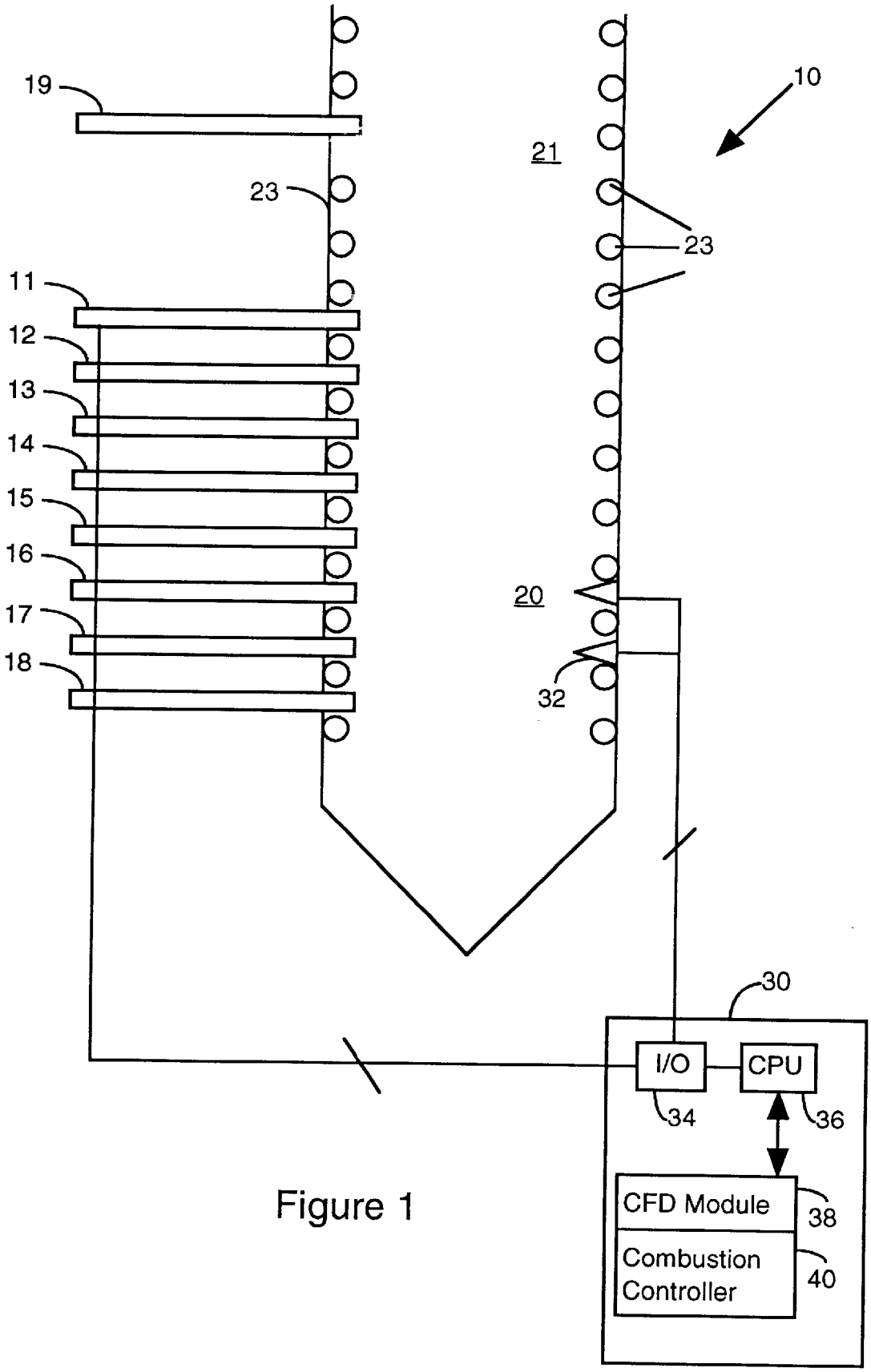
FIG. 1 illustrates a low $NO_x$ boiler that may be operated in accordance with an embodiment of the invention.

FIG. 1 is a sectional view of a low $NO_x$ boiler (10). Eight burners (11–18) are shown in the lower furnace or primary combustion zone (20). An overfire air port (19) is shown in the upper furnace (21). Waterwall tubes (23) line the inside of the boiler (10) (the tubes are shown in a horizontal configuration for convenience, but it should be understood that the tubes are generally in a vertical configuration). Fuel is injected into the primary combustion zone (20) along with combustion air through the burners (11–18) in a set proportion known as the air-to-fuel ratio. Water contained in the waterwall tubes (23) is converted to high pressure steam, which is ultimately used to rotate a turbine (not shown). The flue gas resulting from primary combustion flows to the upper furnace (21) where overfire air is injected through the overfire air port (19) to complete the combustion process. The flue gas then exits the boiler (10).

A computer (30) is connected to a set of sensors (32) that provide data regarding the combustion process within the boiler (10). The computer (30) includes standard input/output devices (34) for interfacing with the sensors (32) and for providing an interface with a human user. The input/output devices (34) interact with a central processing unit (CPU) (36). The CPU (36) executes a set of programs, including a three-dimensional combustion fluid dynamic module (38), as described below. The CPU (36) may also execute a combustion control program (40), which controls the operation of the burners (11)–(19) (e.g., the air-to-fuel ratio) in accordance with a combustion strategy. The computer (30) also operates in an off-line mode wherein the combustion fluid dynamic module (38) is executed, as described below.

Figure 2:
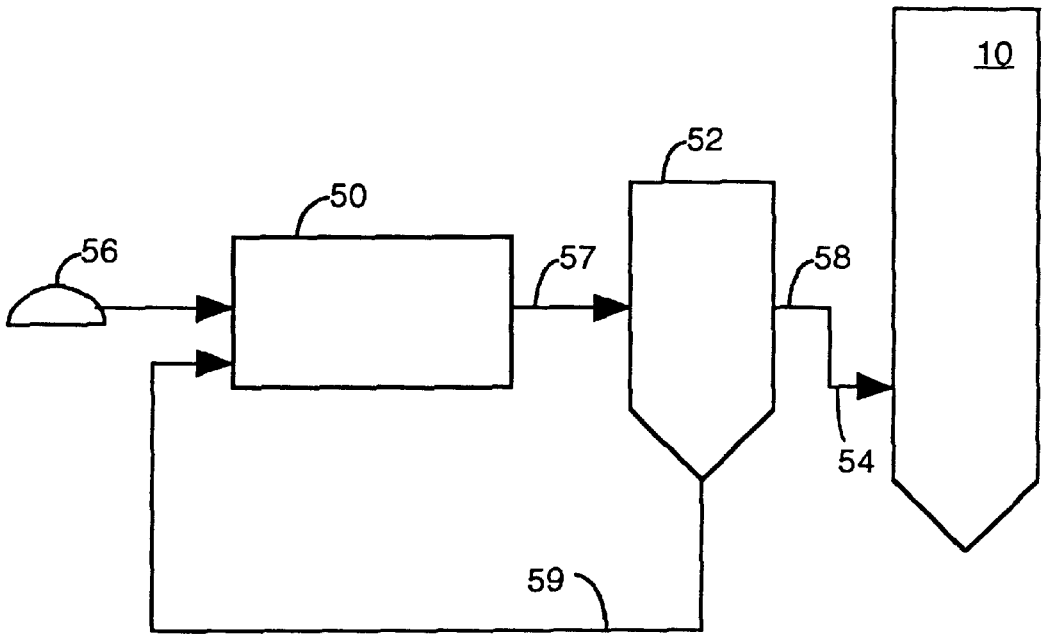
Figure 2 (Prior Art)
FIG. 2 illustrates a coal processing apparatus that may be used to implement the method of the invention.

FIG. 2 is a flow schematic of a coal mill (50) and a classifier (52) for one burner (54). It should be noted that a single coal mill can feed more than one burner. Coal (56) is fed to a coal mill (50), and the resulting ground product stream (57) is fed to a classifier (52) where the ground product is separated into the burner feed stream (58) and a recycle stream (59). The burner feed stream (58) is fed to the burner (54), and the recycle stream (59) is recycled to the coal mill (50). Based upon operation of the classifier (50), the burner feed stream (58) contains smaller particles than the recycle stream (59). The particle size distinction between the burner feed stream (58) and the recycle stream (59) can be varied and is determined by the particular design criteria of the classifier (52).

Figure 3:
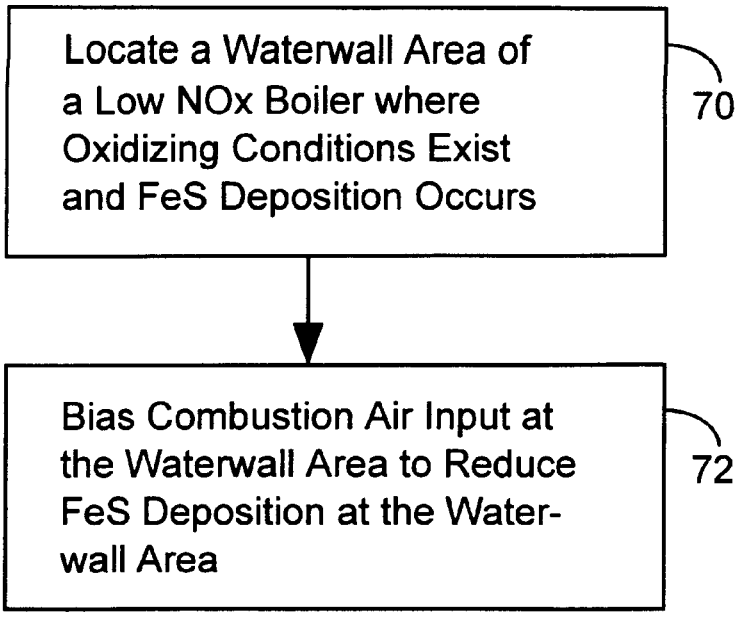
FIG. 3 illustrates processing steps performed in accordance with an embodiment of the invention.

As shown in FIG. 3, the method of the present invention comprises the steps of locating a waterwall area, which includes one or more areas, of a low $NO_x$ boiler where oxidizing conditions exist and deposition of FeS is likely (step 70). The combustion air input from the burners is then biased to reduce FeS deposition on the waterwall in those areas (step 72). The biased combustion air input increases the oxidation rate of $FeS_2$ so as to reduce FeS deposition on the waterwall.

The step of locating areas of FeS deposition where the flue gas in the immediate vicinity is oxidizing is important since these areas exhibit accelerated waterwall corrosion. Table I shows results of laboratory tests that measured the corrosion rate of T-2 steel, which is commonly used for the construction of waterwalls in larger boilers. The corrosion rate was measured under oxidizing and reducing conditions, with various quantities of FeS-rich scale on the steel.

TABLE I

Corrosion Rates (mils/yr) of T-2 Steel at 850° F., Laboratory Test

| % FeS in Deposit | Corrosion Rate (mils/yr) in Oxidizing Conditions | Corrosion Rate (mils/yr) in Reducing Conditions |
|---|---|---|
| 0 | <7 | 15 |
| 20 | 45 | — |
| 30 | 70 | 12 |
| 60 | 115 | 10 |

Table I demonstrates that the presence of reducing conditions by itself will lead to some increase in corrosion rate, but the increase is small in comparison to the corrosion rates experienced in an oxidizing environment in the presence of FeS deposits. Even if the flue gas contacting the FeS containing deposits is alternating between oxidizing and reducing conditions, the average corrosion rate is greatly increased, as is shown in Table II.

TABLE II

Corrosion Rates (mils/yr) of T-2 Steel 850° F., Laboratory Test

| % FeS in Deposit | Corrosion Rates (mils/yr) in Reducing Conditions | Corrosion Rates (mils/yr) in 16 hr Reducing/8 hr Oxidizing Conditions |
|---|---|---|
| 0 | 15–23 | 20 |
| 30 FeS | 5–12 | 42 |
| 60 FeS | 10–20 | 49 |
| 90 FeS | 5–11 | 47 |

The highest corrosion rates found in tangentially-fired boilers equipped with low $NO_x$ systems are generally in the area where the air from the separate overfire air ports mixes with the reducing flue gas (for wall-fired boilers, this area is typically lower in the furnace along the sidewalls). Combustion fluid dynamic modeling indicates that these are also the locations where FeS and carbon deposition is likely, and where the flue gas in the immediate vicinity of the waterwall is oxidizing, as shown in Table III

TABLE III

Combustion Fluid Dynamic Model of Flue Gas Composition in Areas with High Corrosion Rates (vol %)

| Area | $O_2$ | CO | $H_2S$ (ppm) | $H_2O$ | $SO_2$ |
|---|---|---|---|---|---|
| A | 1.5 | 0.5 | 1 | 8.3 | 0.16 |
| B | 5.3 | <0.1 | 0 | 7.2 | 0.13 |

Therefore, the inventors have concluded that corrosion is not caused primarily by the presence of CO and $H_2S$ in a reducing environment, but by the deposition of a FeS-rich scale in areas exposed to oxidizing conditions, such as regions where the overfire air mixes with the reducing gas from the lower furnace. Specifically, it is believed that exposure of this FeS-rich scale to oxidizing conditions results in the FeS reacting with oxygen, $H_2O$ and $CO_2$ to generate high, localized concentrations of $H_2S$ or gaseous sulfur on or near the waterwall tube. This results in increased corrosion, according to the reactions:

$$3FeS+2O_2 \Rightarrow FE_3O_4+3S$$

$$FeS+\tfrac{1}{2}O_2+3H_2O \Rightarrow Fe_3O_4+3H_2S$$

Both reactions are believed to occur simultaneously.

Locating these corrosion prone conditions near the waterwall can be accomplished by utilizing a commercially available three-dimensional combustion fluid dynamic module. That is, the computer (30) may be used to execute a three-dimensional combustion fluid dynamic module (38), such as GLACIER CODE, sold by Reaction Engineering, Salt Lake City, Utah; COMO CODE, sold by Babcock and Wilcox, Alliance, Ohio; or COMBUST CODE, sold by Air Flow Sciences Corporation, Detroit, Mich. Such modeling can predict areas near the waterwall which would be exposed to deposition of FeS and unburned carbon as well as to oxidizing conditions. Alternatively, visual inspection of the waterwall will allow areas of corrosion to be located. Visual inspection will confirm that the corrosion found is indeed caused primarily by FeS deposition and subsequent decomposition to $Fe_3O_4$ and S or $H_2S$.

Once the waterwall area exposed to oxidizing conditions and FeS deposition is located, it is important to identify the burner that releases fuel particles that may impact the waterwall in these areas. Such a fuel particle is deemed to be pre-corrosive fuel particle, since it is the precursor to the formation of the FeS-rich scale. As noted above, combustion modeling and field tests have shown that a low $NO_x$ boiler operating with deep staging can produce a FeS-rich scale deposit on the waterwall tubes. The gaseous, reducing environment in the lower region of a low $NO_x$ boiler is depleted in oxygen. Pyrite ($FeS_2$) will not oxidize to non-corrosive iron oxide ($Fe_3O_4$), but only decomposes to FeS and $H_2S$. When the FeS particles impact on the waterwall, FeS rich deposits will form. The FeS rich deposit tends to stick more easily to the waterwall tube surface due to the deposit's relatively low melting point compared to other constituents in the fuel or combustion products. Burners that discharge $FeS_2$ particles, which are not oxidized to harmless Fe oxide can be identified through the use of the same commercially available three-dimensional combustion fluid dynamic modules discussed above.

Once the burner that causes the deposition of corrosive FeS fuel particles on wall areas where oxidizing conditions exist, at least intermittently, is identified, the step of increasing the oxygen content surrounding such particles will oxidize the pyrite contained in the particles to inert iron oxides, which will not cause corrosion when deposited on the boiler wall. The additional oxygen will also help to combust more of the carbon in the particles, thus reducing the amount of harmful carbon in the deposits. Thus, the formation of FeS-rich deposits on the waterwall and, therefore, corrosion is reduced.

One method for increasing the oxygen content surrounding such pre-corrosive fuel particles is by altering the air-to-fuel ratio of the burner that discharges such particles. By operating the burner at a higher air-to-fuel ratio, the amount of oxygen discharged with the pro-corrosive fuel particle is increased. Therefore, this fuel particle is exposed to higher oxygen levels, resulting in further combustion and possibly the formation of iron oxide molecules instead of FeS.

Combustion fluid dynamic modeling shows that for tangentially-fired boilers, the burners immediately below the separate overfire air ports are mainly responsible for the FeS and carbon deposits in areas where corrosion rates are high. The amount of FeS and carbon in the deposits can be decreased substantially by increasing the air-to-fuel ratio to these burners. This will provide more oxygen to oxidize $FeS_2$ in the fuel particles to harmless iron oxides. In order to maintain the $NO_x$ emissions at the same level as before, it is necessary to reduce the air-to-fuel ratio for the burners that are not responsible for FeS and carbon deposition in corrosive areas. If this is not done, the overall air-to-fuel ratio for all burners will increase, which will result in higher $NO_x$ emissions. This finding is demonstrated with the following example.

EXAMPLE I

A tangentially-fired boiler as shown in FIG. 1 was retrofitted with a low $NO_x$ burner system, including overfire air ports. After the retrofit, excessive corrosion, with losses up to 70 mils/yr was experienced on the rear wall, between the upper burner wall and the separate overfire air ports. A combustion fluid dynamic model of the boiler was constructed to find the root causes of the corrosion problem. It was found that FeS was likely to deposit in corrosive areas, and that oxidizing conditions existed in the areas of maximum corrosion. Further modeling indicated that the FeS deposited in the corrosive area was mostly derived from the upper burner levels. In the original system, recommended by the manufacturer, the upper four burner levels had a low air-to-fuel ratio, as indicated by the a stoichiometric ratio of 0.853, while the lower 4 burner level had a stoichiometric ratio of 0.957. To provide more oxygen to the upper burner levels, their stoichiometric ratio was increased to 0.957 by increasing the air flow and keeping the coal flow constant. The stoichiometric ratio of the lower 4 burner levels was reduced to 0.853 to keep the overall stoichiometric ratio of the burners the same. Table IV gives the results of the changes and indicates a significant reduction in the corrosion potential for the modification implemented in accordance with the invention.

TABLE IV

Improvements in Boiler Performance Through Burner Systems Modification According to the Invention

| Property | Original Burner Setting | Modified Burner Setting |
|---|---|---|
| Max % FeS | 70 | 35 |
| Area with >25% FeS | 95 $ft^2$ | 27 $ft^2$ |
| Max. $H_2S$ Near Waterwall | 979 ppm | 133 ppm |
| Area with >100 ppm $H_2S$ | 166 $ft^2$ | 32 $ft^2$ |
| $NO_x$ Emissions | 200 ppm | 161 ppm |
| Carbon in Flyash | 16.2 | 15.8 |

The data indicate that the modification according to the invention will significantly reduce the deposition of harmful FeS and reduce the area where severe corrosion may be expected. In addition, the modification of the invention greatly reduces the maximum amount and area where harmful $H_2S$ is present. An added benefit of the invention is that $NO_x$ emissions are reduced by 20%, while the carbon content of the flyash is unchanged.

Another method to increase the oxidation of harmful pyrite particles is to reduce or eliminate coarse particles from the pulverized coal fed to the burners. Combustion fluid dynamic modeling has shown that a large fraction of the FeS deposits in the critical corrosive areas is derived from the 250 $\mu$m diameter fraction of the coal fed to the upper burner levels of the boilers. The reason is that the large fuel particles take longer to oxidize, which greatly increases their chance to impinge on the wall before $FeS_2$ is completely oxidized to $Fe_3O_4$. Elimination of the coarse fraction of the pulverized coal can be achieved by replacing the original classifier of the coal pulverizer shown in FIG. 2 with an improved device, which removes a large part of the unwanted coarse fuel particles or eliminates the large fraction altogether. Since the improved classifiers are very costly, it should be stressed that it is only necessary to install them on the burner levels responsible for FeS deposition in critical areas, as demonstrated with the following example.

EXAMPLE II

In the same boiler as the previous example, detailed combustion fluid dynamic modeling showed that FeS deposits were mainly derived from burner levels 6 and 7. The effect of eliminating the 250 $\mu$m fraction from the fuel for these burner levels was therefore modeled. The results are shown in Table V.

TABLE V

Improvements in Boiler Performance Through Elimination of 250 $\mu$m Coal Particles from Burner Levels 6 and 7

| Property | Coal, Including +250 $\mu$m Fraction | Coal, Without +250 $\mu$m Fraction |
|---|---|---|
| Max % FeS | 70 | 46 |
| Area with >25% FeS | 95 $ft^2$ | 76 $ft^2$ |
| Max. $H_2S$ Near Waterwall | 979 ppm | 486 ppm |
| Area with >100 ppm $H_2S$ | 166 $ft^2$ | 220 $ft^2$ |
| $NO_x$ Emissions | 200 ppm | 161 ppm |
| Carbon in Flyash | 16.2 | 13.1 |

This data indicates a more modest, but still significant decrease in corrosion potential, while lowering both $NO_x$ emissions and the amount of unburned carbon in the flyash, which will increase the efficiency of the boiler.

The foregoing description, for purposes of explanation, used specific nomenclature to provide a thorough understanding of the invention. However, it will be apparent to one skilled in the art that the specific details are not required in order to practice the invention. In other instances, well known circuits and devices are shown in block diagram form in order to avoid unnecessary distraction from the underlying invention. Thus, the foregoing description of specific embodiments of the present invention are presented for purposes of illustration and description. They are not intended to be exhaustive or to limit the invention to the precise forms disclosed, many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

We claim:

1. A method to reduce waterwall corrosion in a low $NO_x$ boiler, said method comprising the steps of:

identifying a burner of said low $NO_x$ boiler from which FeS particles are discharged;

locating a waterwall area of said low $NO_x$ boiler where oxidizing conditions exist and deposition of FeS occurs; and biasing the combustion air input at said waterwall area to reduce FeS deposition at said waterwall area.

2. The method of claim 1 wherein said biasing step includes the step of increasing the oxidation rate of $FeS_2$ so as to reduce FeS deposition at said waterwall area.

3. The method of claim 1 wherein said biasing step includes the step of increasing the air-to-fuel ratio of said burner while reducing the air-to-fuel ratio of another burner in said low $NO_x$ boiler such that the overall air-to-fuel ratio in said low $NO_x$ boiler is substantially constant.

4. The method of claim 1 wherein said locating step includes the step of operating a three-dimensional combustion fluid dynamic module to locate said waterwall area.

5. The method of claim 1 wherein said identifying step includes the step of operating a three-dimensional combustion fluid dynamic module to locate said burner.

6. The method of claim 1 wherein said increasing step includes the step of eliminating the coarse fraction of pulverized coal fed to said burner.

7. The method of claim 1 wherein said increasing step includes the step of classifying coal mill discharge of a coal mill that produces a burner feed stream for said burner, such that substantially all fuel particles in said burner feed stream are less than approximately 250 micro-meter in diameter.

* * * * *